US008366138B2

(12) United States Patent
Korpua

(10) Patent No.: US 8,366,138 B2
(45) Date of Patent: Feb. 5, 2013

(54) BINDING FOR FASTENING A BOOT

(75) Inventor: Kimmo Korpua, Kuusamo (FI)

(73) Assignee: Kuusamon Uistin Oy, Kuusamo (FI)

( * ) Notice: Subject to any disclaimer, the term of this patent is extended or adjusted under 35 U.S.C. 154(b) by 266 days.

(21) Appl. No.: 12/778,613

(22) Filed: May 12, 2010

(65) Prior Publication Data

US 2010/0289251 A1 Nov. 18, 2010

(30) Foreign Application Priority Data

May 13, 2009 (FI) ..... 20095534

(51) Int. Cl.
*A63C 9/06* (2006.01)

(52) U.S. Cl. ..... 280/620; 280/11.31; 280/613; 280/615; 280/616; 280/618

(58) Field of Classification Search ..... 280/11.3, 280/11.31, 611, 613, 614, 615, 616, 617, 280/618, 619, 620, 622, 623, 625, 626, 631, 280/632

See application file for complete search history.

(56) References Cited

U.S. PATENT DOCUMENTS

| | | | | | |
|---|---|---|---|---|---|
| 2,130,693 | A | * | 9/1938 | Nashe et al. | 280/619 |
| 2,172,669 | A | * | 9/1939 | Taft | 280/614 |
| 3,388,918 | A | | 6/1968 | Hollenback | |
| 3,901,523 | A | | 8/1975 | Burger | |
| 3,917,296 | A | * | 11/1975 | Gertsch et al. | 280/618 |
| 4,002,354 | A | * | 1/1977 | Ramer | 280/614 |
| 4,273,355 | A | * | 6/1981 | Storandt | 280/614 |
| 4,441,732 | A | * | 4/1984 | Napflin | 280/614 |
| 5,560,633 | A | * | 10/1996 | McGowan | 280/614 |
| 5,577,756 | A | * | 11/1996 | Caron | 280/617 |
| 5,669,622 | A | * | 9/1997 | Miller | 280/615 |
| 5,727,808 | A | * | 3/1998 | Broughton | 280/615 |
| 5,741,023 | A | * | 4/1998 | Schiele et al. | 280/607 |
| 5,893,576 | A | * | 4/1999 | Hauglin | 280/621 |
| 5,947,507 | A | * | 9/1999 | Quintana et al. | 280/615 |
| 6,234,514 | B1 | * | 5/2001 | Dubuque | 280/619 |
| 6,308,979 | B1 | * | 10/2001 | Ludlow | 280/615 |
| 6,371,506 | B1 | * | 4/2002 | DeNicola | 280/607 |
| 6,467,796 | B1 | * | 10/2002 | Weltman et al. | 280/615 |
| 7,246,812 | B1 | * | 7/2007 | Ayliffe | 280/615 |
| 7,264,263 | B2 | * | 9/2007 | Riedel et al. | 280/614 |
| 7,401,802 | B2 | * | 7/2008 | Walker et al. | 280/614 |
| 7,458,598 | B2 | * | 12/2008 | Giffin et al. | 280/615 |
| 7,556,280 | B2 | * | 7/2009 | Holzer | 280/615 |
| 2006/0022432 | A1 | * | 2/2006 | Cunningham et al. | 280/617 |
| 2006/0087102 | A1 | * | 4/2006 | Coles et al. | 280/626 |
| 2007/0235984 | A1 | * | 10/2007 | Miralles | 280/615 |

FOREIGN PATENT DOCUMENTS

FI 118173 B 8/2007

* cited by examiner

*Primary Examiner* — John R Olszewski

(74) *Attorney, Agent, or Firm* — Birch, Stewart, Kolasch & Birch, LLP

(57) ABSTRACT

Binding for fastening a boot (10) into in exercise appliance, such as into a ski (1), which binding comprises at least a support part (4), a tip part (7) installed in the support part, and a heel loop (8), of which the position of at least one or other in the support part (4) can be changed for adjusting the binding to boots of different sizes, and which heel loop (8) is installed in the support part (4) in a manner that allows turning in relation to it. The invention is implemented so that the support part (4) is hinged at its front end so that the support part is hinged around a horizontal axis, such as a hinge pin (5), which is essentially at a right angle in relation to the ski (1).

12 Claims, 4 Drawing Sheets

BINDING FOR FASTENING A BOOT

Figure 1:
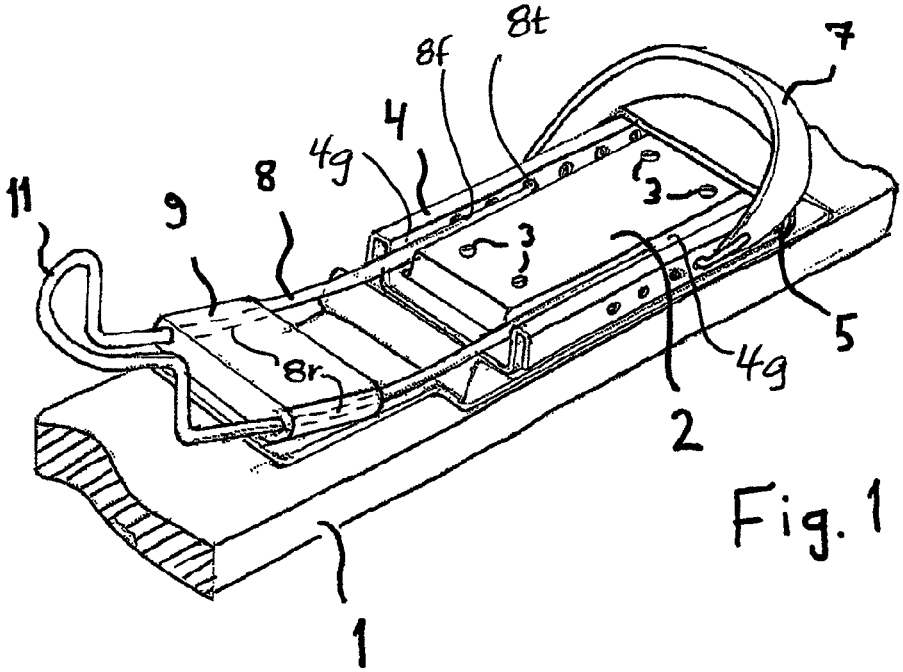

The object of this invention is a binding for fastening a boot into in exercise appliance, such as into a ski, which binding comprises at least a support part, a tip part installed in the support part, and a heel loop, of which the position of at least one or other in the support part can be changed for adjusting the binding to boots of different sizes, and which heel loop is installed in the support part in a manner that allows turning in relation to it.

The invention thus relates to bindings for fastening a boot to an exercise appliance, such as to a ski or snowshoe. In the following the invention will be described as a ski binding, but it must be understood that the invention is not limited exclusively to this purpose of use.

Many types of ski bindings are known in the art. What type of binding is used depends on the purpose of use. In cross-country skiing, in which the skiing is in prepared tracks that are in good condition, tip bindings are generally used, in which the tip of skiing footwear, i.e. of a ski boot, is fastened into the binding. In off-track skiing, where the skiing is also in unbroken snow, different bindings are used, in which e.g. a leather strap or a spring wire passes around the rear of the boot and tightening occurs with a lock at the front or at the side. In these, fastening a boot into the binding requires bending over, which, especially with older people, can be awkward. Additionally, these bindings generally require a certain type of boot.

A ski binding of very simple construction is known from FI patent 118173. The binding comprises a support part fixed onto the ski, and a tip arch installed into it in a hinged manner, and a heel loop. The heel loop is made of a flexible material, such as piano wire, and is bent backwards in an upward curve to the corner of the heel, continuing from there behind the boot as a fastenable heel support. An advantage of this binding is that the boot is fastened into the binding simply by pressing it into place. No separate locking means or fastening means are needed. The boot stays fixed in the binding well when skiing. The position of both the tip arch and heel loop in the support part is easily adjustable for the desired boot size. Also detaching a boot from the binding is easy by pressing the heel loop with the tip of a ski stick behind the heel.

The binding according to the patent has, however, some minor drawbacks. When the boot is large, the heel loop must be adjusted very much toward the rear, in which case the lateral support offered by the support part remains inadequate, especially during a ski kick, when the heel loop turns upward from the support part. Another drawback is the wire-type tip arch, which wears the boot unreasonably because the load is exerted on a small area on top of the boot.

The purpose of the invention is to achieve a new type of binding, to which the aforementioned drawbacks are not attached. The binding according to the invention is characterized in that the support part is hinged at its front end so that the support part is hinged around a horizontal axis, such as a hinge pin, which is essentially at a right angle in relation to the ski.

One preferred embodiment of the binding according to the invention is characterized in that the pivot motion of the support part is limited by the stopper installed in front of it.

Another preferred embodiment of the binding according to the invention is characterized in that the long sides of the heel loop are connected to each other by means of a support piece.

Yet another preferred embodiment of the invention is characterized in that a support piece is disposed in the back part of the heel loop.

One of the advantages of the invention can be considered to be that the boot is easy to fasten into the binding by just kicking the foot into position. The binding thus fastens quickly and firmly without separate locking means. The structure/flexibility of the tip part enables a good fitting for boots of different shapes. In addition, the hinged support part gives better lateral support than earlier.

In the following, the invention will be described in more detail by the aid of some preferred embodiments with reference to the attached drawings, wherein FIG. 1 presents a part of a ski and a binding according to the invention fixed onto it.

Figure 2:
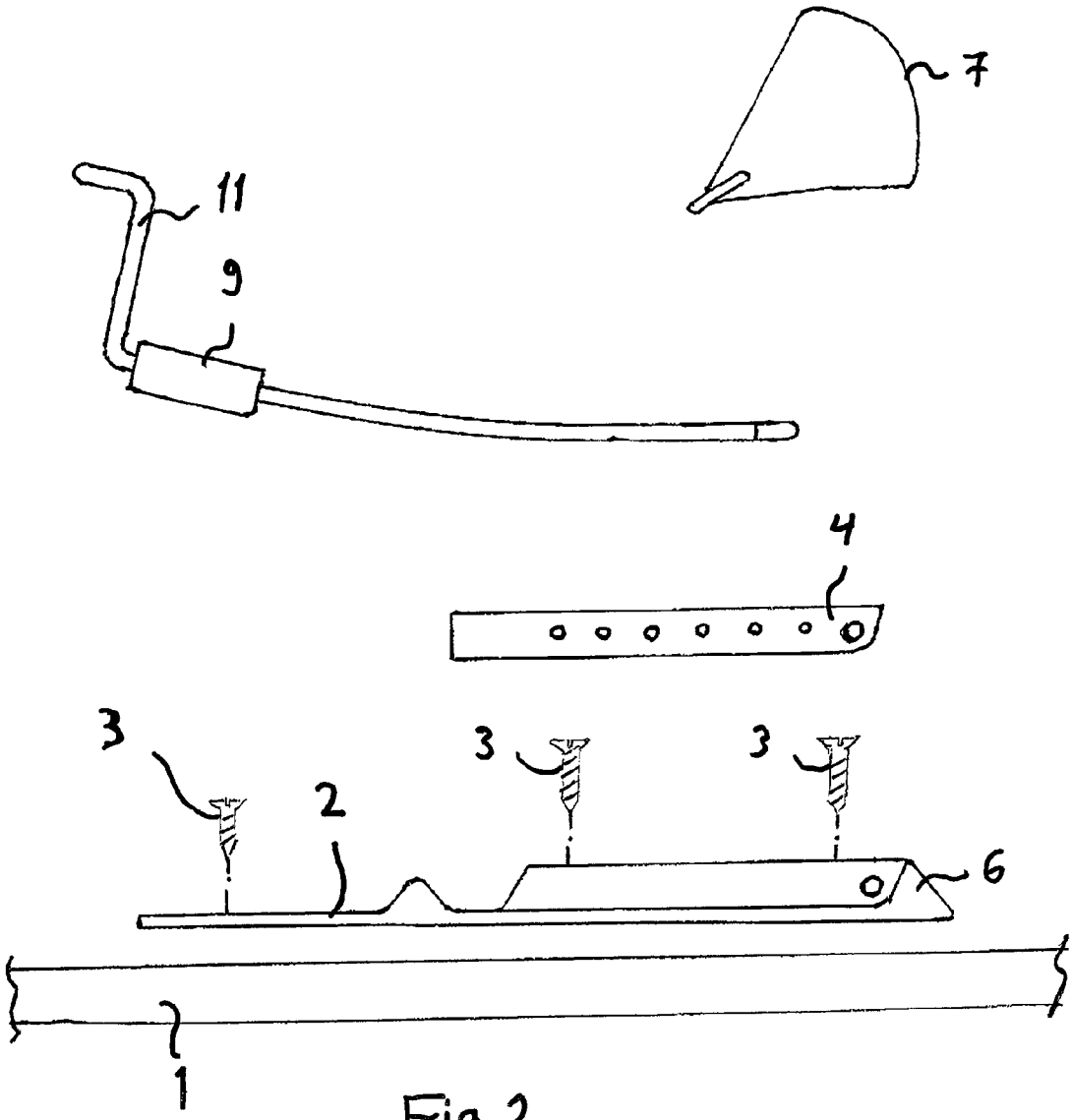

FIG. 2 presents a side view of a ski and a binding as an explosion drawing.

FIGS. 3-6 present a binding and a boot fastened into it in different positions.

FIGS. 1 and 2 present a ski with the reference number 1, in this case an ordinary cross-country ski. A binding according to the invention is fixed to the ski, which binding comprises a fixing part 2, which is fixed with screws 3 to the ski. A pivoted support part 4 is hinged to the fixing part. The hinging is effected with a hinge pin 5, which is pushed through the holes in the support part 4 and in the fixing part 2. The hinge pin 5 is seen more clearly in FIGS. 3-6, and it is thus at a right angle with respect to the longitudinal direction of the ski 1 and essentially horizontal. The hinge pin 5 is disposed in the front part of the support part, in which case the back part of the support part is able to move in the vertical direction (FIGS. 5 and 6), i.e. the support part turns around the hinge pin. The pivot motion of the support part is however limited by means of the stopper 6 in the fixing part 2.

A tip part 7 is fixed to the support part 4, which tip part is formulated to be cup-shaped and at least slightly flexible, in which case it accepts the tip of a boot 10. When the tip part 7 is formulated in the way presented in the drawing, it is well suited to many types of boot 10 and, in addition, the stress exerted on the boot by the binding is distributed evenly in the tip of the boot. The tip part is also hinged because it is fixed with pins or hooks into holes in the support part 4. The material and shape of the support part can, of course, vary according to need. The fixing of the tip part to the support part is detachable, so that its position can be changed according to the size of the boot. One possibility is to make a groove around the (back of) the tip part, which snaps closed into a corresponding fixing wire fixed into the support part. In this case the tip part can easily be changed according to the desired size, color and/or shape.

A bendable heel loop 8, which extends behind the boot 10 in the manner presented in FIGS. 3-6, is also fixed into the support part 4. The heel loop 8 is preferably a continuous wire, e.g. a piano wire, the front tips 8*t* of which are detachably fixed into an intermediate portion of the support part 4 in the manner presented in the drawings. This fixing method enables turning (rotating) of the heel loop 8 in relation to the support part 4. Also, the position of the front tips 8*t* of the heel loop 8 can be changed according to the size of the boot 10. The support part 4 comprises grooves 4*g*, in which forward long side parts 8*f* of the heel loop 8 move and are, owing to the grooves 4*g*, supported in the lateral direction for most of the time. Rear long side parts 8*r* of the heel loop 8 are connected to each other by means of a support piece 9 in the rear part of the heel loop 8. An essentially right-angled upward bend is made in the heel loop 8 behind the support piece 9, in which case an essentially flexible back arch 11 is formed for keeping the boot 10 in the binding.

Figure 3:
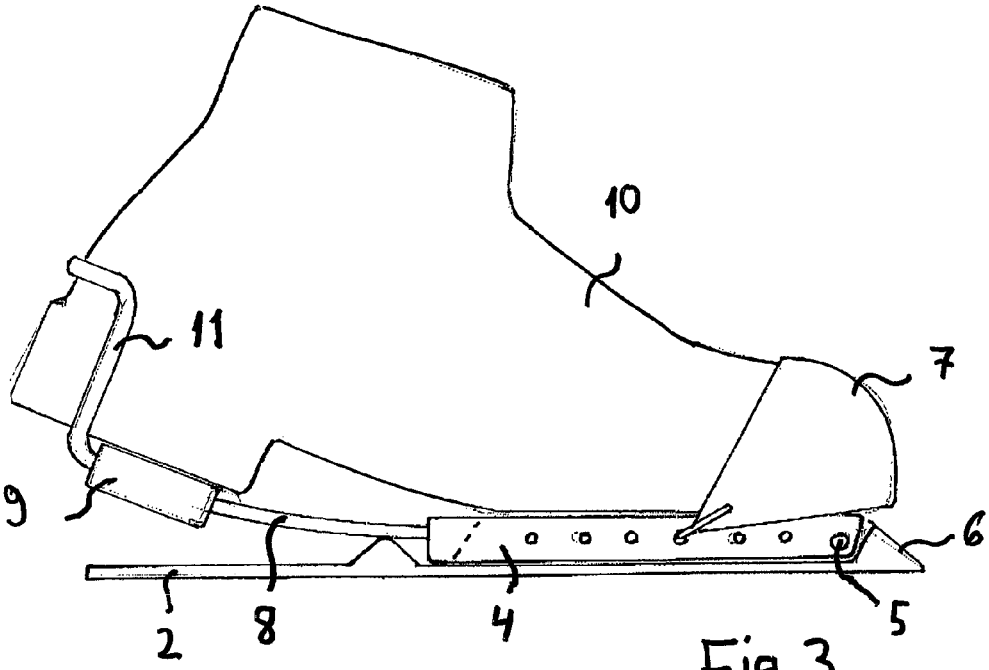
Figure 4:
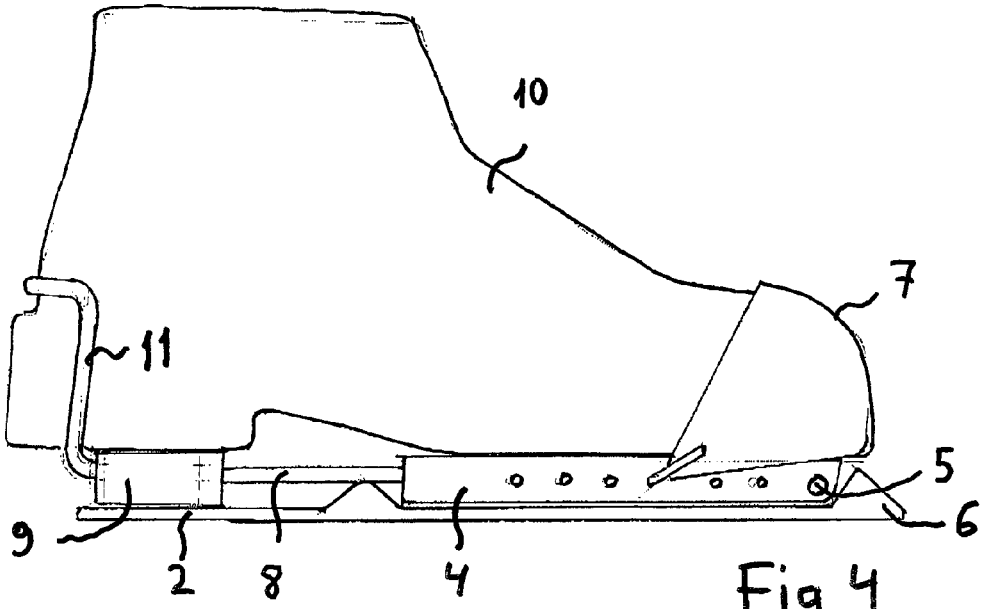

FIGS. 3-6 present the operation of the binding according to the invention during use. At first, therefore, the tip of the boot 10 is pushed into the tip part 7 and after that the heel is pressed down, in which case the back arch 11 of the heel loop 8 settles against the back part of the boot 10 and the boot fastens into the binding. Thus no extra locking means are needed for this. In the rest position, the heel loop 8 is slightly upward curving, as shown in FIG. 3. As can be seen in each of FIGS. 3-6, the support piece 9 is located behind the support part 4, the support part 4 of the binder for supporting a front portion of the boot 10, the support piece 9 for supporting a heel portion of the boot 10. In FIG. 3, the support plate 4 rests firmly on the flat surface of fixing plate 2, and support piece 9 is positioned at an angle to the surface of the fixing plate 2. However, when the boot is fastened into the binding and is upright, and weight of the boot is on the ski, the support piece 9 of the binding, which connects the rear long side parts 8*r* of the heel loop 8 together, presses against the flat surface of the ski (or the flat surface of the fixing part 2) forming a support, as shown in FIG. 4.

Figure 5:
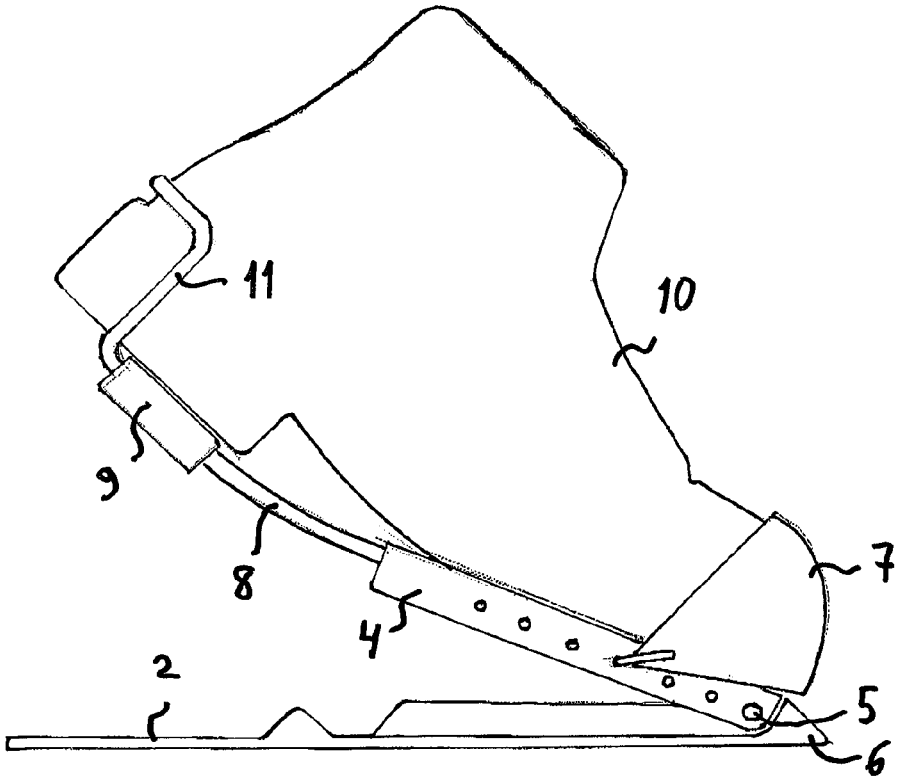
Figure 6:
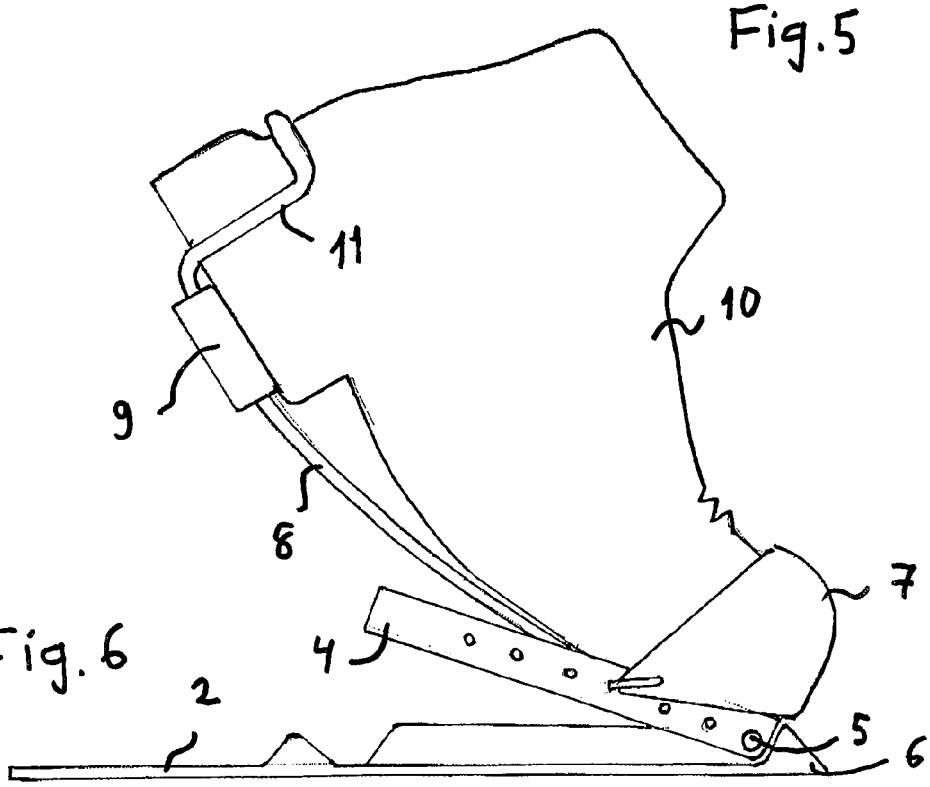

FIG. 5 presents the situation during skiing when the heel of the boot and at the same time the support piece 9 has risen up from the ski. In this stage, the support part 4 is still on the same line with the forward long side parts 8*f* of heel loop 8, but the stopper in the fixing part 2 limits the turning of the support part 4. In this situation, the forward long side parts 8*f* of the heel loop 8 remain in the grooves 4*g*. After that, the forward long side parts 8*f* of the heel loop 8 can still rise to some extent from the support part 4, as is presented in FIG. 6. In this situation, the forward long side parts 8*f* of the heel loop 8 rise to some extent out of grooves 4*g*. This depends on the adjustments of the binding. In principle, the distance between the heel arch and the tip part, between which the boot 10 is situated, decreases when the forward long side parts 8*f* of the heel loop 8 rise in relation to the support part 4, which also starts to prevent the rising of the heel loop. In other words, when the heel loop 8 is in an unbent state, the support piece 9 is parallel to the support part 4, and when the heel loop 8 is in a bent state, the support piece 9 and the support plate 4 are not parallel to each other.

When it is desired to detach the boot from the binding, the back arch 11 can be pressed with a ski stick, and the heel of the boot lifted out of the binding.

It is obvious to the person skilled in the art that the invention is not limited to the embodiment presented above, but that it can be varied within the scope of the claims presented below. The materials of the different parts are not presented in more detail above, but they can be any sufficiently durable materials whatsoever that are suited to the purpose, such as plastic and metal. In addition, the shapes of the parts can differ from what is presented, according to need. Different details such as the stopper 6, can be implemented in another way also. It is also obvious that the binding according to the invention can be used also in other exercise appliances than in skis, e.g. in snowshoes.

The invention claimed is:

1. A binding for fastening a boot into in exercise appliance, comprising:

at least a support part, a tip part installed in the support part, and a bendable heel loop, a position of at least one of the tip part or the bendable heel loop in the support part being changeable for adjusting the binding to boots of different sizes, the bendable heel loop being rotatably and detachably installed in the support part in a manner that allows turning of the bendable heel loop in relation to the support part while the boot is fastened into the binding, wherein a front end of the support part is hinged by a hinge pin around a horizontal axis, the horizontal axis extending in a direction that is substantially at a right angle in relation to a length of the exercise appliance, and the support part is provided with grooves along left and right sides thereof, and when the bendable heel loop is in an unbent state, portions of the bendable heel loop remain in the grooves.

2. The binding according to claim 1, wherein a pivot motion of the support part is limited by a stopper installed in front of the support part.

3. The binding according to claim 2, wherein long sides of the heel loop are connected to each other by a support piece.

4. The binding according to claim 2, wherein the tip part is formulated substantially according a shape of a tip of a boot, and to be at least partly flexible such that the stress exerted on the boot by the tip part is distributed over an extensive area.

5. The binding according to claim 1, wherein rear long side parts of the heel loop are connected to each other by a support piece.

6. The binding according to claim 5, wherein the support piece is disposed in the rear long side parts of the heel loop.

7. The binding according to claim 6, wherein the tip part is formulated substantially according to a shape of a tip of a boot and to be at least partly flexible such that the stress exerted on the boot by the tip part is distributed over an extensive area.

8. The binding according to claim 5, wherein the tip part is formulated substantially according to a shape of a tip of a boot and to be at least partly flexible such that the stress exerted on the boot by the tip part is distributed over an extensive area.

9. The binding according to claim 1, wherein the tip part is formulated substantially according to a shape of a tip of a boot, and to be at least partly flexible such that the stress exerted on the boot by the tip part is distributed over an extensive area.

10. The binding according to claim 1, wherein the binding includes a support piece located behind the support part, the support part of the binder for supporting a front portion of the boot, and the support piece for supporting a heel portion of the boot.

11. A binding for fastening a boot into in exercise appliance, comprising:

at least a support part having grooves along left and right sides thereof, a tip part installed in the support part, and a bendable heel loop having front tips rotatably and detachably installed in an intermediate portion of the support part, a position of at least one of the tip part or the front tips of the heel loop in the support part being changeable for adjusting the binding to boots of different sizes, the heel loop being installed in the support part in a manner that allows turning of the heel loop in relation to the support part, wherein a front end of the support part is hinged by a hinge pin around a horizontal axis, the horizontal axis extending in a direction that is substantially at a right angle in relation to a length of the exercise appliance, wherein the support part is provided with grooves along left and right sides thereof, and when the heel loop is in an unbent state, portions of the heel loop directly behind the front tips remain in the grooves, and depending on an extent of bending of the heel loop, the portions of the heel loop directly behind the front tips lift out of the grooves to some extent.

12. The binding according to claim 11, wherein the binding includes a support piece located behind the support part, the support part of the binder for supporting a front portion of the boot, and the support piece for supporting a heel portion of the boot, and when the heel loop is in an unbent state, the support piece is parallel to the support part, and when the heel loop is in a bent state, the support piece and the support part are not parallel to each other.

* * * * *